US007527036B2

(12) United States Patent
Ricco et al.

(10) Patent No.: US 7,527,036 B2
(45) **Date of Patent: *May 5, 2009**

(54) SERVO VALVE FOR CONTROLLING AN INTERNAL COMBUSTION ENGINE INJECTION

(75) Inventors: Mario Ricco, Valenzano (IT); Sisto Luigi De Matthaeis, Valenzano (IT); Adriano Gorgoglione, Valenzano (IT); Alfonso Di Meo, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/741,474

(22) Filed: Apr. 27, 2007

(65) Prior Publication Data

US 2007/0205302 A1 Sep. 6, 2007

Related U.S. Application Data

(63) Continuation of application No. 11/112,772, filed on Apr. 21, 2005, now Pat. No. 7,219,656.

(30) Foreign Application Priority Data

Jun. 30, 2004 (EP) ..... 04425475

(51) Int. Cl.
*F02M 37/04* (2006.01)

(52) U.S. Cl. ..... 123/467; 123/500

(58) Field of Classification Search ..... 123/467, 123/500, 501, 446, 447
See application file for complete search history.

(56) References Cited

U.S. PATENT DOCUMENTS 6,085,719 A 7/2000 Heinz et al.
6,257,499 B1 7/2001 Sturman
6,293,254 B1 9/2001 Crofts et al.
6,581,850 B1 6/2003 Boecking et al. ..... 239/102.2
6,705,291 B2 3/2004 Rueger et al.
6,745,952 B1 * 6/2004 Hlousek ..... 239/88
6,837,221 B2 1/2005 Crofts et al.
6,845,756 B2 * 1/2005 Ruthardt et al. ..... 123/467

(Continued)

FOREIGN PATENT DOCUMENTS

DE 43 10 984 A1 10/1994

(Continued)

*Primary Examiner*—Stephen K Cronin
*Assistant Examiner*—Arnold Castro
(74) *Attorney, Agent, or Firm*—Oblon, Spivak, McClelland, Maier & Neustadt, P.C.

(57) ABSTRACT

A control servo valve is housed inside the casing of an internal combustion engine fuel injector, and has an actuator, a control chamber communicating with a fuel inlet and with a fuel outlet passage, and a shutter movable along an axis by the actuator between a closed position and an open position to close and open the outlet passage respectively; the servo valve also has a fixed axial rod interposed between the actuator and the control chamber; the outlet passage comes out through an outer lateral surface of the axial rod; and the shutter is defined by a sleeve which slides axially on the outer lateral surface, and, in the closed position, closes the outlet passage so as to be subjected to a zero axial resultant force by the pressure of the fuel.

17 Claims, 2 Drawing Sheets

U.S. PATENT DOCUMENTS 7,021,278 B2 * 4/2006 Ishizuka et al. ..... 123/299
7,044,109 B2 * 5/2006 Ricco ..... 123/467

FOREIGN PATENT DOCUMENTS

EP 0 740 068 A3 10/1996
JP 2003-515045 4/2003
WO WO 01/11227 A 2/2001

* cited by examiner

SERVO VALVE FOR CONTROLLING AN INTERNAL COMBUSTION ENGINE INJECTION

CROSS-REFERENCE TO RELATED APPLICATIONS

This application is a Continuation of and claims the benefit of priority under 35 U.S.C. §120 from U.S. Ser. No. 11/112,772, filed Apr. 21, 2005, now U.S. Pat. No. 7,219,656, and claims the benefit of Priority under 35 U.S.C. 119 from European Application No. 04425475.3, filed Jun. 30, 2004, the entire contents of which are incorporated herein by reference.

BACKGROUND OF THE INVENTION

1. Field of the Invention

The present invention relates to a servo valve for controlling an internal combustion engine fuel injector.

2. Description of the Related Art

As is known, an injector comprises an injector body which defines a nozzle for injecting fuel into the engine, and houses a control rod movable along a respective axis to activate a pin closing the nozzle. The injector body also houses an electromagnetic control servo valve comprising a control chamber bounded axially on one side by the control rod, and on the other by an end wall having a calibrated axial outlet hole which, outside the control chamber, comes out axially inside a conical seat. The control servo valve also comprises a shutter, which engages the conical seat and is activated by an electromagnetic actuator to move axially to and from the seat to open and close the outlet hole and so vary the pressure inside the control chamber.

More specifically, the shutter is subjected on one side to the axial thrust exerted by the pressure of the fuel in the outlet hole, and, on the other side, to the action of the actuator and the axial thrust of a spring preloaded to keep the outlet hole closed when the actuator is not energized.

Known solutions as described above are unsatisfactory, on account of the characteristics and size of the shutter positioning spring having to be such as to exert a high preload, e.g. of about 70 newtons, to keep the outlet hole closed at high pressure (even as high as 1800 bars), so that powerful actuators are also required.

To minimize the above drawbacks, an attempt has been made to minimize the shutter sealing area to reduce pressure on the shutter. Because of the smaller sealing area, however, discharge of the control volume to activate the injection nozzle calls for relatively high lift (about 50 microns) of the shutter to uncover large enough flow sections, which lift is undesirable.

Moreover, a strong closing force of the shutter and direct axial exposure of the shutter to high pressure cause "bounce" of the shutter when closing. That is, the shutter actually bounces, as opposed to settling immediately, on the sealing seat.

SUMMARY OF THE INVENTION

It is an object of the present invention to provide a servo valve for controlling an internal combustion engine fuel injector, designed to solve the above problems in a straightforward, low-cost manner, and which preferably is easy to produce and assemble, is compact, and comprises a small number of components.

According to the present invention, there is provided a servo valve for controlling an internal combustion engine fuel injector; the servo valve being housed in a casing of said injector, and comprising:

actuating means;

a control chamber communicating with a fuel inlet and a fuel outlet passage; and a shutter movable, along a longitudinal axis by said actuating means, between a fully closed position, in which it closes said outlet passage, and a fully open position, in which it leaves said outlet passage open, to close and open an end nozzle of said injector;

characterized by also comprising an axial rod in a fixed position with respect to said casing; and in that said outlet passage comes out through an outer lateral surface of said axial rod; said shutter being fitted to said outer lateral surface in axially sliding and substantially fluid-tight manner, and, in said fully closed position, closing said outlet passage so as to be subjected to a zero axial resultant force by the pressure of the fuel.

The above solution provides for a roughly 50% reduction in lift of the shutter, and a roughly 30% reduction in closing force; and the fact that the shutter is balanced assists in reducing "bounce" of the shutter.

BRIEF DESCRIPTION OF THE DRAWINGS

A non-limiting embodiment of the invention will be described by way of example with reference to the accompanying drawings, in which.

DETAILED DESCRIPTION OF THE PREFERRED EMBODIMENTS

Figure 1:
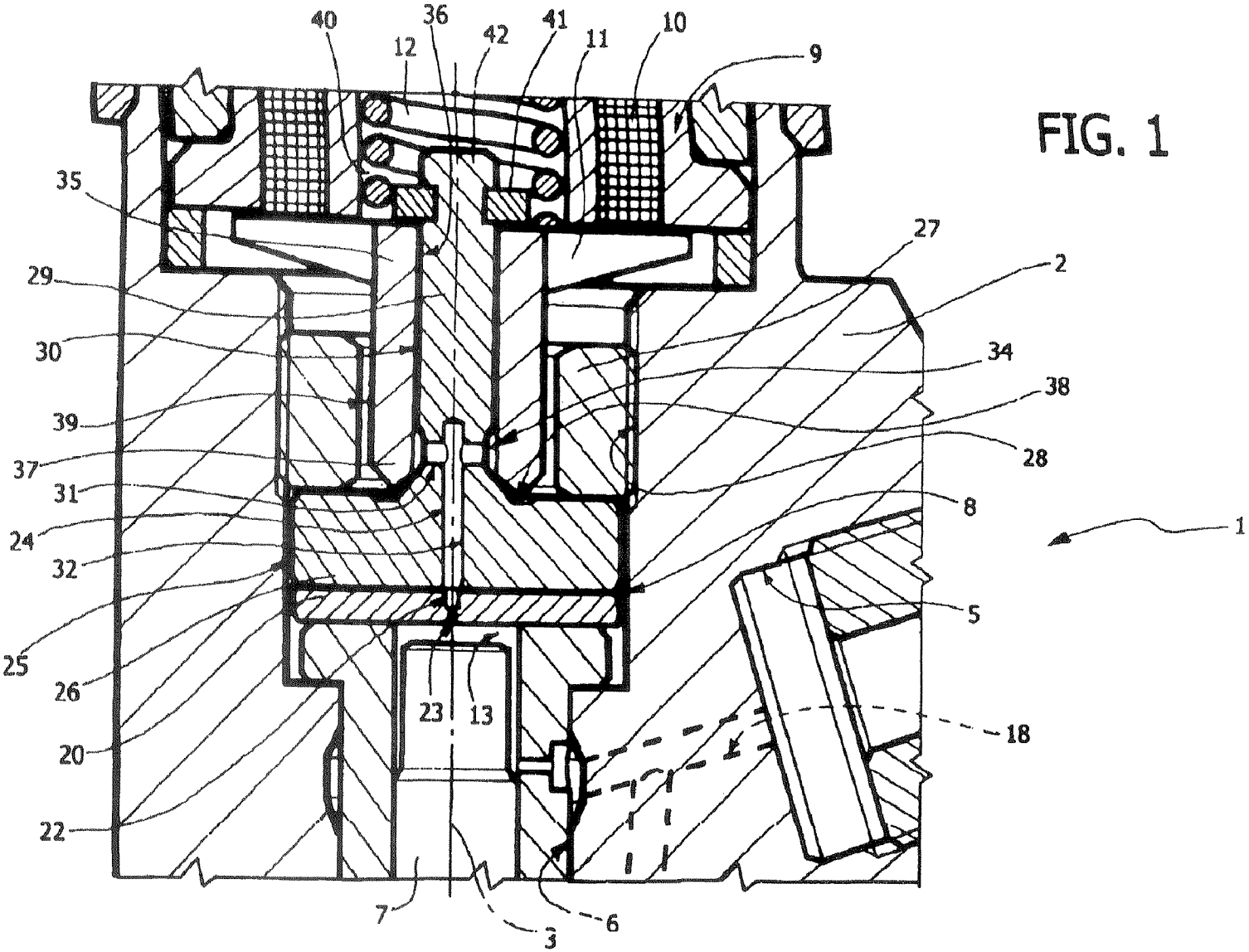
FIG. 1 shows a section, with parts removed for clarity, of a preferred embodiment of a servo valve for controlling an internal combustion engine fuel injector in accordance with the present invention.

Referring now to the drawings, wherein like reference numerals designate identical or corresponding parts throughout the several views.

Number 1 in FIG. 1 indicates as a whole a fuel injector (shown partly) of an internal combustion engine, in particular a diesel engine (not shown). Injector 1 comprises an outer structure or casing 2 which extends along a longitudinal axis 3, has a lateral inlet 5 for connection to a pump forming part of a fuel feed system (not shown), and terminates with a nozzle (not shown) communicating with inlet 5 and for injecting fuel into a relative cylinder of the engine.

Casing 2 defines an axial seat 6, and houses a rod 7 which slides axially and in fluidtight manner inside seat 6 to control a shutter pin (not shown) for closing and opening the fuel injection nozzle.

Casing 2 houses a control servo valve 8 comprising an actuating device 9, which is coaxial with rod 7 and comprises an electromagnet 10; a segmental armature 11 which slides axially inside casing 2 under the control of electromagnet 10; and a preloaded spring 12 surrounded by electromagnet 10 and which exerts thrust on armature 11 in the opposite direction to attraction by electromagnet 10.

Servo valve 8 comprises a control chamber 13 which is formed in an intermediate axial position between actuating device 9 and rod 7, communicates permanently with inlet 5 along a passage 18 to receive pressurized fuel, and is bounded axially on one side by rod 7, and on the other by an end disk 20 housed in a fixed position inside casing 2.

Chamber 13 comprises an outlet passage 22 symmetrical with respect to axis 3, and which comprises a calibrated-section hole 23 formed along axis 3 in disk 20, and an end portion 24 formed in a distribution body 25 located in an intermediate axial position between disk 20 and actuating device 9.

Body 25 comprises a base 26 gripped axially against disk 20, in fluidtight manner and in a fixed position, by a ring nut 27, which is screwed to an inner surface 28 of casing 2 and rests axially on an outer annular portion of base 26. Body 25 also comprises a rod or pin 29, which projects from base 26 along axis 3 in the opposite direction to chamber 13, is formed in one piece with base 26, is bounded externally by a cylindrical lateral surface 30, and has two diametrically opposite, inner radial holes 31. Holes 31 form part of portion 24, communicate in fluidtight manner with hole 23 via an intermediate hole 32 formed along axis 3 in base 26, and come out of pin 29, in an axial position adjacent to base 26, inside an annular chamber 34 formed along surface 30.

The outlet of passage 22, defined by chamber 34, is opened/closed by a shutter defined by a sleeve 35, which is activated by actuating device 9 to vary the pressure in control chamber 13 and so open and close the injection nozzle by axial translation of rod 7.

Sleeve 35 is formed in one piece with armature 11, and has a cylindrical inner surface 36 which mates in substantially fluidtight manner with surface 30 with a sufficiently small calibrated diametrical clearance, e.g. of less than 4 micron, or with the interposition of sealing elements, such as rings made of bronze-filled PTFE or materials known by the trade names "Turcite" or "Turcon".

Sleeve 35 slides axially, along surface 30, between a fully forward position, in which it closes passage 22 and an end 37 of sleeve 35 rests on a conical shoulder 38 connecting surface 30 to base 26, and a fully withdrawn position, in which it leaves passage 22 open. More specifically, in the fully forward position, the fuel exerts zero axial resultant thrust on sleeve 35, by virtue of the pressure in chamber 34 acting radially on surface 36; and, in the fully withdrawn position, fuel flows from passage 22 to a discharge or recirculating channel (not shown) through an annular passage 39 defined by ring nut 27 and sleeve 35, through armature 11, and through the cavity 40 housing spring 12.

The fully forward position of sleeve 35 is defined by the sleeve contacting shoulder 38; and the fully withdrawn position is defined by a ring 41 fitted in a fixed position to an end 42 of rod 29. More specifically, end 42 projects axially with respect to sleeve 35 into cavity 40.

Figure 2:
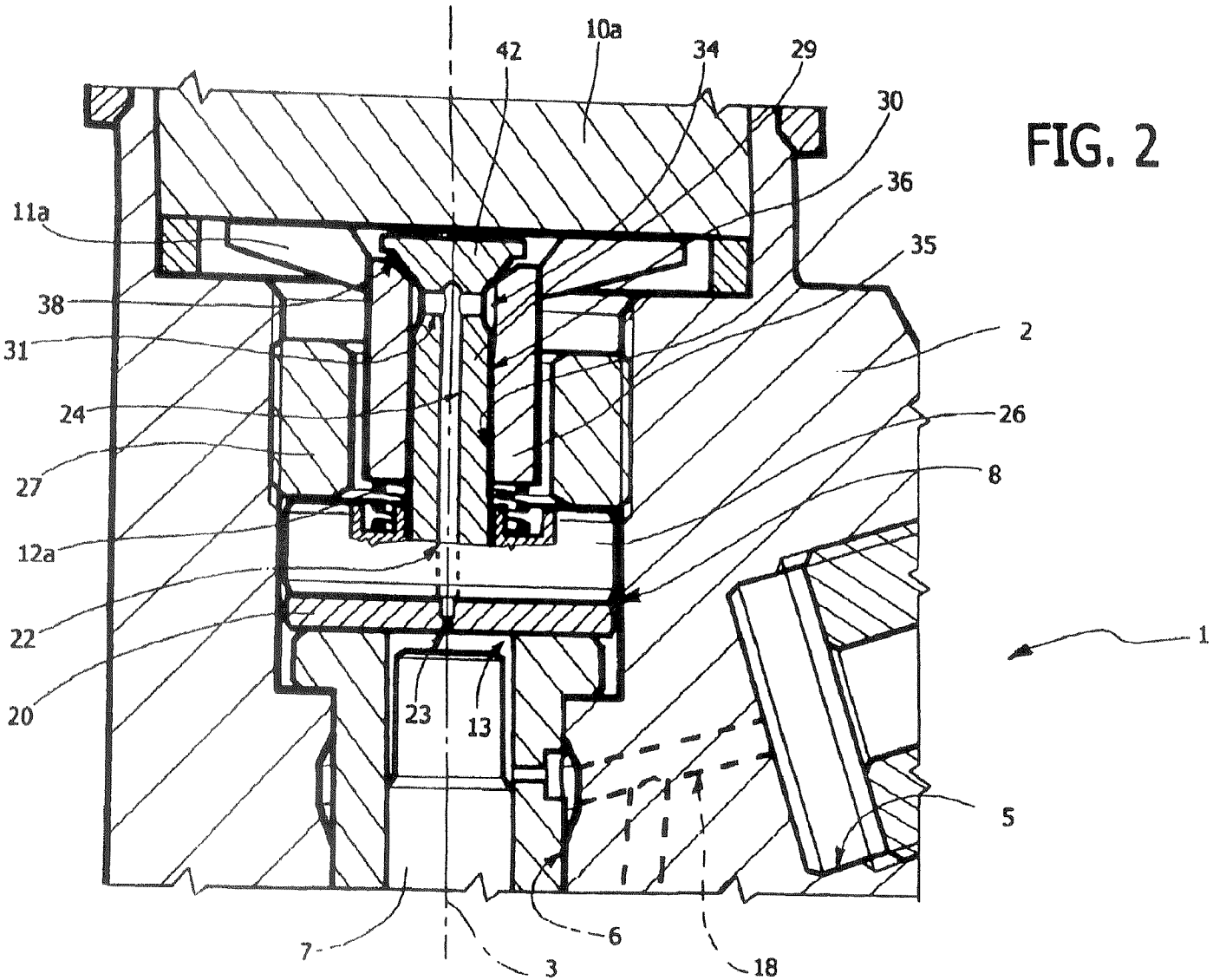
FIG. 2 is similar to FIG. 1, and shows a variation of the FIG. 1 control servo valve.

FIG. 2 shows a variation of servo valve 8, the component parts of which are indicated where possible using the same reference numbers as in FIG. 1.

The FIG. 2 variation differs from the embodiment described above, by electromagnet 10 being replaced by a piezoelectric actuator 10*a* (shown partly), which, when subjected to voltage, increases in size axially to activate sleeve 35 to open the outlet of passage 22.

More specifically, chamber 34 and shoulder 38 are formed adjacent to end 42, and spring 12 is replaced by a spring 12*a* interposed axially between sleeve 35 and base 26 to push sleeve 35 axially, in opposition to the axial thrust of actuator 10*a*, into the fully withdrawn position closing chamber 34 in fluidtight manner.

In the FIG. 2 variation, sleeve 35 rests axially against actuator 10*a* with the interposition of appendixes 11*a* formed in one piece with sleeve 35; and rod 29 and base 26 are defined by separate parts fitted to each other in a fixed position and in fluidtight manner, so as to enable sleeve 35 and spring 12*a* to be fitted about rod 29 at assembly.

In a further embodiment not shown, chamber 34 and shoulder 38 are adjacent to base 26 (as in FIG. 1), and a transmission system is provided between piezoelectric actuator 10*a* and sleeve 35 to withdraw sleeve 35 towards end 42 and open the outlet of passage 22 when actuator 10*a* increases in size axially. The transmission system is such that, at assembly, body 25 with rod 29 can first be inserted axially and fitted in place, followed by sleeve 35, possible together with armature 11.

As will be clear from the foregoing description, the characteristics of passage 22, and the sliding fit, along axis 3, of sleeve 35 and rod 29 provide for axially balancing pressure on sleeve 35 in the closed position. Which balance, as stated, permits a roughly 30% reduction in the preload of spring 12, 12*a*, a reduction in the force required of the electric actuator (10, 10*a*), and therefore a reduction in the size of spring 12 and the electric actuator, as compared with known solutions in which the shutter closes the outlet of hole 23 frontally.

Moreover, even only a small amount of lift or axial travel of sleeve 35 produces ample flow sections, thus improving dynamic performance of injector 1.

By virtue of axial rod 29 being fixed and defining an inner axial guide member for sleeve 35, holes 23 and 32 can be formed along axis 3, thus greatly simplifying manufacture and assembly of servo valve 8. In fact, if holes 23 and 32 were located at a distance from axis 3, relatively complex adjusting systems would have to be provided to so position base 26 and disk 20 angularly as to keep holes 23 and 32 aligned.

The absence of such adjusting systems, forming body 25 in one piece, and forming armature 11 and sleeve 35 in one piece, provide for a relatively small number of component parts, and therefore relatively easy assembly and highly accurate fit.

Given the characteristics of base 26, rod 29 can be fitted to casing 2 easily by means of a ring nut 27, which is normally featured anyway in known solutions.

The fact that the limit stops of sleeve 35, i.e. ring 41 and shoulder 38, are carried on rod 29 disassociates total travel of sleeve 35 and of armature 11 from the position of electromagnet 10. Moreover, any displacement or elastic deformation of body 25 also produces displacement of ring 41, and therefore has substantially no effect on the total travel of sleeve 35 between its limit positions.

Using a piezoelectric actuator 10*a* greatly simplifies manufacture of injector 1, by eliminating the electric windings of electromagnet 10.

Clearly, changes may be made to the control servo valve 8 as described and illustrated herein without, however, departing from the scope of the present invention.

In particular, chamber 34 may be formed in surface 36, while still providing for zero resultant pressure on the shutter, defined by sleeve 35, in the fully closed position.

Calibrated hole 23 may be formed in rod 29, and in particular may be defined by a radial portion between chamber 34 and hole 32.

As opposed to engaging an annular groove on end 42, ring 41 may rest axially on a further member distinct from rod 29 and connected, e.g. screwed, interference-fitted, or glued, in a fixed position to rod 29.

Obviously, numerous modifications and variations of the present invention are possible in light of the above teachings. It is therefore to be understood that within the scope of the appended claims, the invention may be practiced otherwise than as specifically described herein.

The invention claimed is:

1. An internal combustion engine fuel injector comprising:

an outer casing ending with a nozzle for injecting fuel into a relative cylinder of the engine;

a shutter pin movable for closing and opening said nozzle;

a rod member housed in said outer casing and slidable along an axial direction to and configured control the movement of said shutter pin;

a control servo valve housed in said outer casing and comprising:

a) an actuating device;

b) a control chamber, which communicates with a fuel inlet and a fuel outlet passage having a calibrated portion, and the pressure of which controls axial sliding of said rod member housed in said casing; and c) a shutter movable, along a longitudinal axis by said actuating device between a full closed position, in which said outlet passage is thereby closed, and a fully open position, in which said outlet passage is thereby opened, to vary the pressure in said control chamber in order to close and open said nozzle;

wherein said control servo valve also comprises an axial rod in a fixed position with respect to said casing; and wherein said outlet passage comes out through an outer lateral surface of said axial rod; said shutter being fitted to said outer lateral surface in an axially sliding and substantially fluidtight manner, and, in said fully closed position, closing said outlet passage so as to be subjected to a zero axial resultant force by the pressure of the fuel and wherein said axial rod and said shutter pin are coaxial with said shaft configured to control said shutter pin, wherein said outlet passage is formed in an end portion of said axial rod and formed in a base fixed to said casing by a ring nut and integral with said axial rod.

2. A fuel injector as claimed in claim 1, wherein said axial rod and said base are formed in one piece.

3. A fuel injector as claimed in claim 1, wherein said outlet passage is symmetrical with respect to said longitudinal axis.

4. A fuel injector as claimed in claim 3, wherein said outlet passage comes out inside an annular chamber formed radially between said axial rod and said shutter.

5. A fuel injector as claimed in claim 1, wherein said shutter comprises a cylindrical inner surface, which slides axially on said outer lateral surface and radially closes said outlet passage.

6. A fuel injector as claimed in claim 1, wherein said actuating device comprises an electromagnetic actuator; said shutter being integral with an armature of said electromagnetic actuator.

7. A fuel injector as claimed in claim 1, wherein said actuating device comprises a piezoelectric actuator.

8. A fuel injector as claimed in claim 1, which comprises a first limit stop member which includes a conical shoulder as one piece with said axial rod, and which comprises a second limit stop member which includes a stop ring fitted to said axial rod.

9. A fuel injector as claimed in claim 1, wherein said calibrated portion is formed in a position adjacent to said control chamber.

10. A fuel injector as claimed in claim 9, wherein said calibrated portion is formed axially in a body distinct from said axial rod; and said outlet passage comprises at least one radial outlet portion formed in said axial rod and communicating in fluidtight manner with said calibrated portion.

11. A fuel injector as claimed in claim 1, wherein said calibrated portion is formed in said axial rod.

12. A fuel injector as claimed in claim 11, wherein said calibrated portion is formed at the end of said outlet passage.

13. A fuel injector as claimed in claim 1, wherein said outlet passage comprises an end portion formed in said axial rod, and in a base fixed to said casing by a ring nut and integral with said axial rod.

14. A fuel injector as claimed in claim 13, wherein said axial rod and said base are formed in one piece.

15. A fuel injector as claimed in claim 1, wherein said shutter is fitted to said outer lateral surface with a calibrated clearance.

16. A fuel injector as claimed in claim 1, wherein said shutter is fitted to said outer lateral surface with the interposition of sealing members.

17. A fuel injector as claimed in claim 1, wherein said outlet passage has an inlet aperture and wherein said axial rod and said shutter pin are coaxial with said inlet aperture of said fuel outlet passage.

* * * * *